US008904953B2

(12) United States Patent
Lamkemeyer

(10) Patent No.: US 8,904,953 B2
(45) Date of Patent: Dec. 9, 2014

(54) APPARATUS FOR APPLYING GLUE TO REGIONS OF PAPER OR PLASTIC WEBS OR PAPER OR PLASTIC WEB-SECTIONS AND A METHOD FOR PRODUCING THE SAME

(75) Inventor: Andreas Lamkemeyer, Georgsmarienhuette (DE)

(73) Assignee: Windmoeller & Hoelscher KG, Lengerich (DE)

( * ) Notice: Subject to any disclaimer, the term of this patent is extended or adjusted under 35 U.S.C. 154(b) by 73 days.

(21) Appl. No.: 13/151,581

(22) Filed: Jun. 2, 2011

(65) Prior Publication Data

US 2011/0297079 A1 Dec. 8, 2011

(51) Int. Cl.

| | |
|---|---|
| ***B05B 7/06*** | (2006.01) |
| ***B05C 5/00*** | (2006.01) |
| ***B05C 5/02*** | (2006.01) |
| *B05B 1/30* | (2006.01) |

(52) U.S. Cl.

CPC ..... *B05C 5/0279* (2013.01); *B05B 1/302* (2013.01); *B05C 5/0216* (2013.01); *B31B 2219/60* (2013.01); *B31B 2219/6007* (2013.01); *B31B 2221/20* (2013.01)

USPC ..... 118/313; 118/315; 118/325; 156/578

(58) Field of Classification Search

USPC ..... 118/300, 313–315, 325; 427/427.3; 156/578; 137/15.22, 247.21, 315.18, 137/449, 519.5, 533.11

See application file for complete search history.

(56) References Cited

U.S. PATENT DOCUMENTS

| | | | | |
|---|---|---|---|---|
| 4,488,665 | A | 12/1984 | Cocks et al. | |
| 5,875,922 | A | 3/1999 | Chastine et al. | |
| 2006/0160685 | A1 | 7/2006 | Lamkemeyer | |
| 2009/0107398 | A1 * | 4/2009 | Hassler et al. | 118/315 |

FOREIGN PATENT DOCUMENTS

| | | |
|---|---|---|
| DE | 103 27 646 | 3/2004 |
| DE | 103 09 893 | 4/2004 |
| DE | 103 30 751 | 2/2005 |
| EP | 2 055 394 | 5/2009 |
| WO | WO 02/096570 | 12/2002 |

* cited by examiner

*Primary Examiner* — Yewebdar Tadesse

(74) *Attorney, Agent, or Firm* — Jacobson Holman Hershkovitz, PLLC.

(57) ABSTRACT

An apparatus for applying glue to regions of paper or plastic webs or paper or plastic web-sections for the production of paper sacks includes a nozzle unit having a plurality of glue outlet openings and glue supply lines and a plurality of glue valves via which the glue supply lines can be provided selectively with glue. Each glue valve includes at least one tappet having a sealing head and at least one counter element, with which the sealing head can make sealing contact. The apparatus includes a glue chamber via which glue can be provided. The counter element is disposed in, or in close vicinity to, the glue chamber.

20 Claims, 2 Drawing Sheets

IV-IV
V
V
x
a

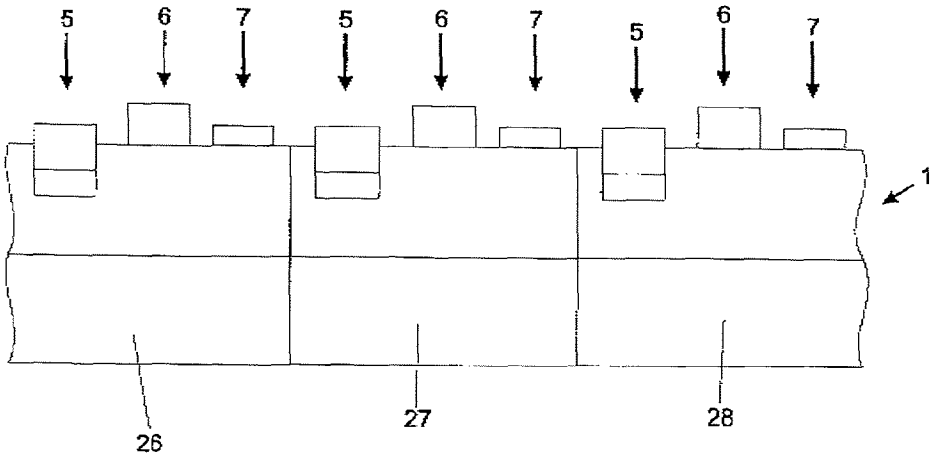
Fig. 5 V-V
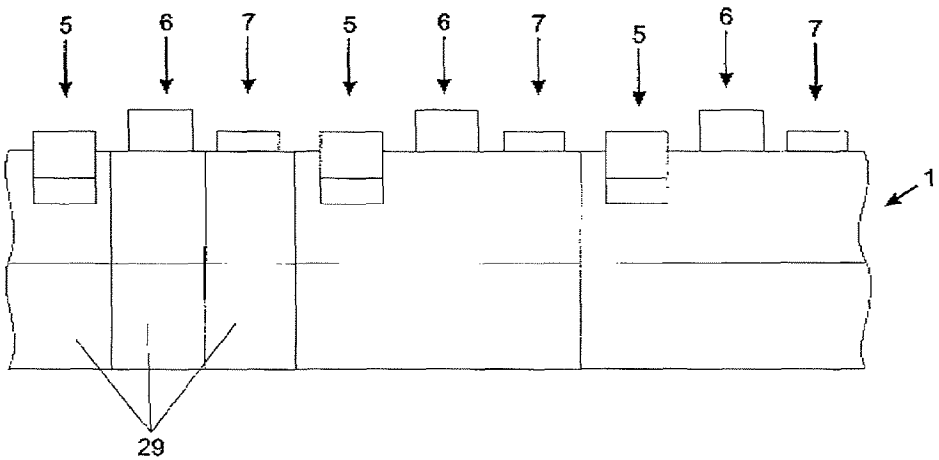
Fig. 6

APPARATUS FOR APPLYING GLUE TO REGIONS OF PAPER OR PLASTIC WEBS OR PAPER OR PLASTIC WEB-SECTIONS AND A METHOD FOR PRODUCING THE SAME

CROSS-REFERENCE TO RELATED APPLICATIONS

This application claims the priority of German number 10 2010 029 678.3 filed Jun. 2, 2010, hereby incorporated by reference.

BACKGROUND OF THE INVENTION

1. Field of Invention

The invention relates to an apparatus for applying glue to regions of paper or plastic webs or paper or plastic web-sections. The apparatus includes a nozzle unit having a plurality of glue outlet openings and glue supply lines and a plurality of glue valves, via which the glue supply lines are provided selectively with glue. Each glue valve includes at least one tappet having a sealing head and at least one counter element, with which the sealing head can make sealing contact. The apparatus also includes a glue chamber, via which the glue is provided. The invention also relates to a method of producing the above-described apparatus for applying glue.

2. Description of the Prior Art

An apparatus of the type mentioned above is described in detail in the patent application DE 103 09 893. In the production of paper sacks, it is necessary to provide different components with adhesive. Initially, a tube is shaped out of a web or a plurality of webs forming a multilayered web, one or more traces of glue being applied in the longitudinal direction to regions of the web that are then overlapped by other regions of the web (so-called tube forming). The webs can be made of paper and/or plastic. The tube formed is separated into tube pieces, on which bottoms are molded subsequently, and adhesive is applied again to parts of these tube pieces for gluing the bottoms. Frequently, starch glue is used as the adhesive. Therefore, the word "glue" is used in place of the word "adhesive" in the following parts of this application without restricting the subject matter of the invention.

DE 103 09 893 suggests the use of apparatuses that apply the glue in the desired format by means of a plurality of glue valves instead of glue application rollers that carry the format-dependent plates and that have been in use for decades. The format, in which the glue is applied, can be influenced by suitably controlling individual valves in terms of time. Such apparatuses often comprise a nozzle unit comprising a plurality of glue outlet openings and glue supply lines for these glue outlet openings. Furthermore, the glue valves, by means of which the glue supply lines and thus the glue outlet openings can be provided selectively with glue, are disposed on this nozzle unit. Moreover, the nozzle unit comprises at least one glue chamber, by means of which glue can be provided. The glue is guided to the glue valves by means of glue lines. Glue can flow from the glue chamber through the valves to the glue outlet openings and thus onto the work piece by opening the glue valves. Each glue valve comprises at least one tappet comprising a sealing head that is alterable in terms of its position. This sealing head cooperates with a counter element. For this purpose, the sealing head can make sealing contact with the counter element so that glue cannot flow past the sealing head and through the counter element. When the sealing contact is lifted, the glue valve opens and the glue can flow into the glue supply line. An apparatus of this type of construction is disclosed in the patent application DE 103 30 751.

The nozzle unit is often of two-piece construction, the glue outlet openings and glue supply lines being usually inserted into a nozzle plate. The nozzle head often supports the glue valves and the glue chamber.

The disadvantage of arrangements disclosed in the prior art is that prefabricated glue valves are arranged on the nozzle unit. For this purpose, the nozzle unit must be provided with different bores for each valve, which bores can initially guide the glue from the glue chamber to the surface of the nozzle unit, on which the glue valve is disposed, and which then guide the glue from the valve to the glue outlet opening/s in question. The insertion of bores into the nozzle unit is always associated with high costs. Prefabricated glue valves are also expensive.

SUMMARY OF THE INVENTION

It is therefore an object of the present invention to provide an apparatus and a method, by means of which costs can be saved.

According to the invention, this object is achieved by the features described herein. Accordingly, provision is made for the counter element of a glue valve to be disposed in or in close vicinity of the glue chamber. For example, the counter element can be disposed in the transition region between the glue chamber and the glue supply line or it can be formed of this transition region. Since the sealing head cooperates with the counter element, the valve can be said to be integrated in the glue chamber. The major advantage of this feature is that it is now possible to completely dispense with the glue lines that bring the glue from the glue chamber to the valves. This considerably reduces the number of bores in the nozzle unit, which consequently cuts costs. There is also no requirement of a separate housing comprising an independent chamber for the valves themselves. As a result of dispensing with the lines guiding the glue, the effort required for the maintenance and, more particularly, the cleaning of the apparatus is also reduced. Moreover, the integration of the valves in the nozzle unit results in a smaller, more compact overall size of the entire nozzle unit.

In an advantageous development of the invention, provision is made for the counter element to be in the form of an independent component and be placed in the transition region between the glue chamber and the glue supply line. This enables the counter element to be replaced easily when, for example, the valve leaks as a result of wear. The counter element can be sealed relative to the glue supply line by means of a sealing component, for example, an O-ring.

It is particularly advantageous if the counter element is cylindrical or discoidal with a thread on its external surface and is screwed into a bore that is provided with an internal thread and is inserted into the glue supply line. This embodiment primarily enables simpler and thus more cost-effective assembly.

It is further advantageous if the counter element is provided with a hexagon socket on one of its ends, preferably on the end oriented toward the glue chamber. The base of this hexagonal recess can provide the locating surface for the sealing head. The opening for the glue can then be provided in the locating surface.

Additional aspects of the invention explained below relate to the tappet. In a related embodiment of the invention, the tappet passes, at least in part, through the glue chamber. This enables a space-saving arrangement of the drive moving the tappet.

In this connection, it is advantageous if the tappet can be displaced by means of an electromagnetic displacement drive. For this purpose, the tappet can comprise magnetic or magnetizable elements that are surrounded by a coil, by means of which a switchable magnetic field can be generated. One major advantage of this feature is that there is no requirement of providing a mechanical connection of the tappet with the space located outside the nozzle unit.

It is of particular advantage if the electromagnetic displacement drive is disposed directly on the glue chamber. Thus the bores required for the electromagnetic displacement drive can be kept short. Moreover, it is also possible to save space in doing so.

A very simple production of the apparatus of the invention is possible if the electromagnetic displacement drive is disposed diametrically relative to the counter element. In this case, the tappet intersects the axis of the glue chamber, if the latter has a round cross section. In the case of a different cross section of the glue chamber, the tappet intersects the axis of the cylinder that can be inscribed in the glue chamber.

Provision is made in an additional advantageous embodiment of the invention for the directions, in which the tappets of two glue valves extend, to be disposed so as to be rotated about the axis of the glue chamber relative to each other. More particularly, when this feature relates to two adjacent valves, these valves can be placed close together in spite of the spatial dimensions of the drives moving the tappets so that the largest possible number of glue outlet openings can be provided per unit length. Two adjacent valves can be rotated by 30 degrees relative to each other, for example.

The nozzle unit can be made, at least in part, of plastic. Firstly, this can simplify production and secondly, this material is cost-effective. Another major advantage is that such a material does not transmit the magnetic field generated by the electromagnetic displacement drive of one valve to an adjacent valve as strongly as is the case in a metallic environment, for example.

Furthermore, the nozzle unit can comprise a plurality of individual segments. A small number of valves can be assigned to such a segment. It is advantageous to assign an individual valve to each segment. It can also be advantageous to assign a plurality of valves to each segment. Thus it is possible to provide as many valves until the arrangement pattern relating to the mutual pivoting of the valves is repeated. For example, if three valves pivot relative to each other and the pivot angle of the fourth valve corresponds to that of the first valve then three valves would have to be provided for each segment. In the case of a segmentation of the nozzle unit, the segments can be produced very cost-effectively since they are each identical. Depending on the desired size of the nozzle unit, only a corresponding number of segments are required to be strung together. Each segment naturally includes a component of the glue chamber, these glue chamber components of the segments being congruent. These glue chamber components can then be in the form of simple cross-holes inside the segments. As a result, a sealing element must be provided between every two segments. The segments can be attached to each other. For this purpose, the segments can be provided, for example, with through-holes, in which threaded rods or other traction mechanisms can be inserted. The individual segments can be pressed against each other by means of these traction mechanisms and corresponding fixing agents such as nuts. The external end faces of the outer segments can each be provided with terminating elements for the glue chamber.

BRIEF DESCRIPTION OF THE DRAWINGS

Additional exemplary embodiments of the invention are revealed in the following description and the claims. In the individual figures:

FIG. 5 shows a section taken along line V-V marked in FIG. 1

FIG. 6 corresponds to FIG. 5, but shows smaller segments.

DETAILED DESCRIPTION OF THE PREFERRED EMBODIMENTS

Figures 1, 2, 3, 4:
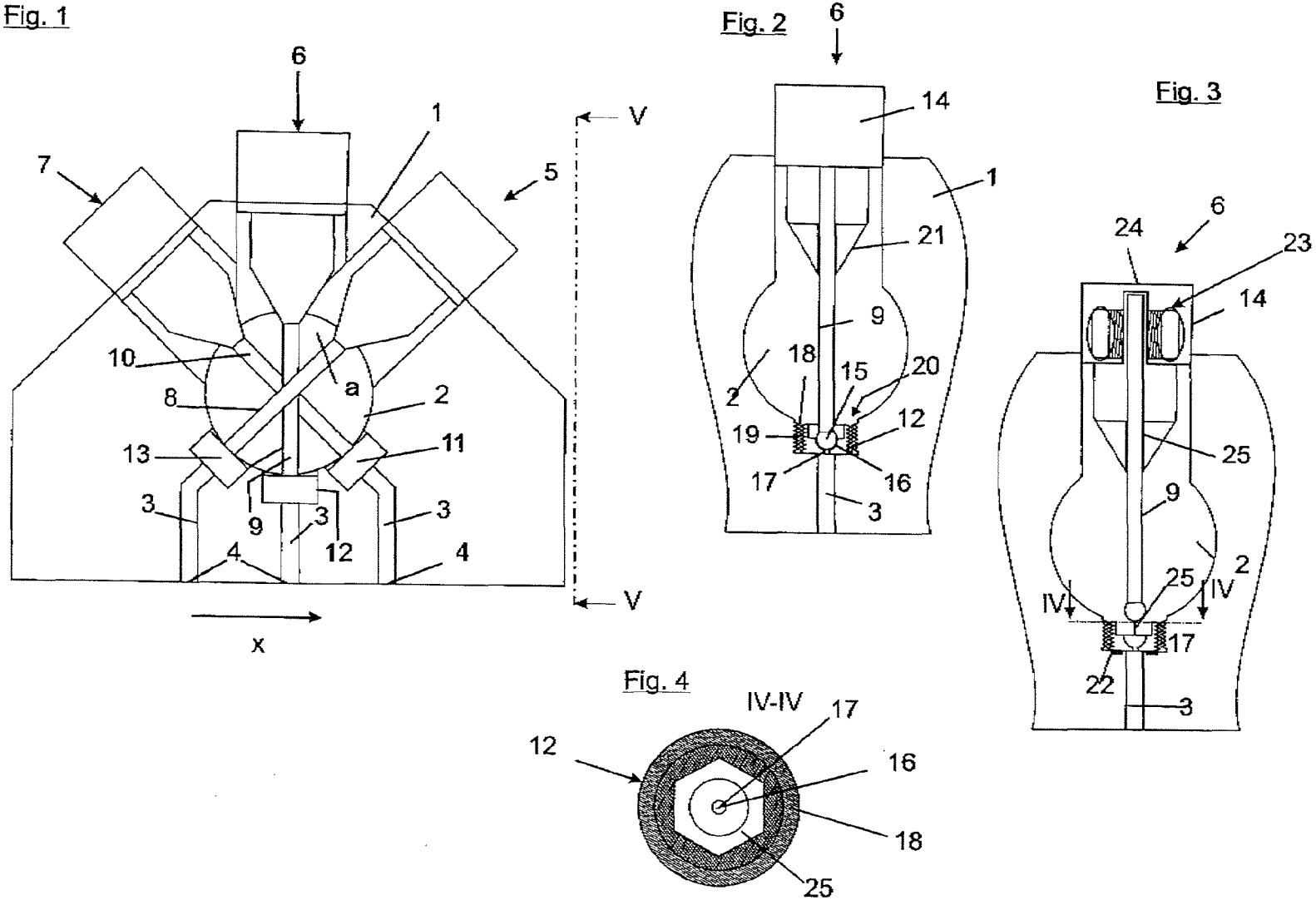
FIG. 1 is a sectional drawing of the nozzle unit of an apparatus of the invention
FIG. 2 is a sectional drawing of a cut-out of FIG. 1
FIG. 3 corresponds to FIG. 2, but shows an open valve
FIG. 4 shows a section taken along line IV-IV marked in FIG. 3

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIG. 1 is a sectional drawing of the nozzle unit 1 of an apparatus of the invention. The central element of this nozzle unit 1 is the glue chamber 2 that extends transversely relative to the transport direction x of the work pieces (not shown in the figures). A plurality of glue supply lines 3 that open out into glue outlet openings 4 branch off from the glue chamber 2. For the purpose of enabling a clearer view, these glue outlet openings are shown as being disposed at various positions, when viewed in the direction x. In practice, the glue outlet openings 4 can also be arranged differently, for example, on a line extending transversely relative to the direction x.

Valves 5, 6, 7, by means of which the flow of glue through the associated glue supply lines 3 can be enabled or interrupted, are assigned to each glue outlet opening or also a plurality thereof. For this purpose, each of these valves comprises a tappet 8, 9, 10 that can be moved by drives (not shown in detail) in the directions, in which the tappets extend. Each tappet comprises a sealing head that cooperates with counter elements 11, 12, 13 as described further below.

The individual valves can be arranged so as to be rotated relative to each other. The example of valves 5 and 6 shown in FIG. 1 reveals that the directions, in which the tappets 8 and 9 extend, together enclose an angle $\alpha$ as a result of this arrangement. This angle $\alpha$ can take a value of 30 to 60 degrees, and more preferably 45 degrees, for example.

FIG. 2 is a sectional drawing of a cut-out of FIG. 1. It shows the valve 6 comprising the tappet 9. The valve 6 comprises a housing 14, which is permanently connected, for example, screwed to the nozzle unit 1. For this purpose, a bore 21 is inserted into the nozzle unit. The valve can also be integrated in the nozzle unit 1 without a housing, but this option is not shown in the figures. The tappet 9 supports a sealing head 15 that is spherical in shape. This sealing head fits in a ball socket-shaped indentation 16 provided in the counter element 12. An opening 17 representing a connection from the glue chamber 2 to the glue supply line 3 is provided in this indentation. However, if the sealing head 15 is in contact with the indentation—as shown in FIG. 2—this opening 17 closes and glue cannot flow into the glue supply line 3.

The counter element 12 is cylindrical or discoidal and it comprises, on its external surface, an external thread 18, by means of which the counter element 12 is screwed into the thread 19 of a bore 20. Advantageously, the diameter of this bore 20 is smaller than that of the bore 21, through which the valve 6 passes. For sealing the counter element 12 relative to the nozzle unit 1, an O-ring 22 can be provided, which is shown in FIG. 3. Other sealing elements are likewise feasible.

FIG. 3 now shows the valve 6 in its open state, in which the tappet 9 has been moved away from the counter element 12 so that the opening 17 is now unblocked, and a flow of glue from the glue chamber 2 to the glue supply line 3 is thus enabled.

A coil 23 comprising a guide 24, in which the tappet 9 is guided, is provided as the drive for displacing the tappet 9. An additional guide 25 can also be provided. The guide 24 is sealed relative to the interior of the housing 14, in which the coil is located so that glue cannot flow from the glue chamber 2 or the bore 21 into the interior of the coil.

FIG. 4 shows a section taken along line IV-IV marked in FIG. 3. This figure shows that the indentation 16 is provided in a recess 25 that, in turn, is shaped like a hexagon in a top view. This recess thus forms a hexagon socket that enables the counter element to be screwed easily into the bore 20 by means of a commercially available tool.

FIG. 5 shows a section taken along line V-V marked in FIG. 1. In this connection, it must be emphasized that the figure shows only one of many possible ways of designing the nozzle unit 1 shown in FIG. 1. FIG. 5 shows that valves 5, 6, 7 are disposed on each of the segments 26, 27 and 28. This embodiment is advantageous since all segments are identical. A nozzle unit can comprise a plurality of assembled segments that can be connected together, as described further above. The nozzle unit is thus of modular construction and can be configured subsequently to meet the respective requirements.

FIG. 6 shows an additional example of a segmented nozzle unit 1. The segments 29 support only one valve each so that the length of the nozzle unit can be altered more gradually. It is not necessary for all the segments of a nozzle unit to support the same number of valves. The number of valves per segment can vary, as shown likewise in FIG. 6.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference numerals | |
|---|---|
| 1 | Nozzle unit |
| 2 | Glue chamber |
| 3 | Glue supply line |
| 4 | Glue outlet opening |
| 5 | Valve |
| 6 | Valve |
| 7 | Valve |
| 8 | Tappet |
| 9 | Tappet |
| 10 | Tappet |
| 11 | Counter element |
| 12 | Counter element |
| 13 | Counter element |
| 14 | Housing |
| 15 | Sealing head |
| 16 | Indentation |
| 17 | Opening |
| 18 | External thread |

-continued

| List of reference numerals | |
|---|---|
| 19 | Thread |
| 20 | Bore |
| 21 | Bore |
| 22 | O-ring |
| 23 | Coil |
| 24 | Guide |
| 25 | Recess |
| 26 | Segment of the nozzle unit comprising three valves |
| 27 | Segment of the nozzle unit comprising three valves |
| 28 | Segment of the nozzle unit comprising three valves |
| 29 | Segment of the nozzle unit comprising one valve |
| 30 | |
| x | Transport direction |

What is claimed is:

1. An apparatus for applying a glue to regions of paper or plastic webs or paper or plastic web-sections for the production of paper sacks, said apparatus comprising:

a nozzle unit including a plurality of glue outlet openings and glue supply lines, and a plurality of glue valves via which the glue supply lines can be provided selectively with the glue, each of the glue valves including at least one tappet having a sealing head and at least one counter element, with which the sealing head can make sealing contact; and a glue chamber, via which the glue can be provided, the at least one counter element being disposed in, or in close vicinity to, the glue chamber, and wherein directions in which the at least one tappet of two of the glue valves extend are disposed so as to be rotated relative to each other.

2. The apparatus according to claim 1, wherein the at least one counter element is configured as an independent component and is located in a transition region between the glue chamber and the glue supply line.

3. The apparatus according to claim 1, wherein the at least one counter element is cylindrical or discoidal with a thread on an external surface thereof, and is threaded into a bore that is provided with an internal thread, and is inserted into the glue supply line.

4. The apparatus according to claim 2, wherein the at least one counter element includes a hexagon socket on one end thereof.

5. The apparatus according to claim 1, wherein the at least one tappet passes, at least in part, through the glue chamber.

6. The apparatus according to claim 1, wherein the at least one tappet is displaceable via an electromagnetic displacement drive.

7. The apparatus according to claim 6, wherein the electromagnetic displacement drive is disposed directly on the glue chamber.

8. The apparatus according to claim 6, wherein the electromagnetic displacement drive is disposed diametrically relative to the counter element.

9. The apparatus according to claim 1, wherein the nozzle unit has a material of construction that includes plastic.

10. The apparatus according to claim 1, wherein the nozzle unit includes a plurality of segments that can be positioned together in a direction of the glue chamber and can be attached to each other.

11. An apparatus for applying a glue to regions of paper or plastic webs or paper or plastic web-sections for the production of paper sacks, said apparatus comprising:

a nozzle unit including a plurality of glue outlet openings and glue supply lines, and a plurality of glue valves via which the glue supply lines are provided selectively with the glue, each of the glue valves including at least one tappet having a sealing head and at least one counter element, with which the sealing head makes sealing contact; and a glue chamber, via which the glue is provided, the at least one counter element (i) being disposed in, or in close vicinity to, the glue chamber, and (ii) being cylindrical or discoidal with a thread on an external surface thereof, and being threaded into a bore that is provided with an internal thread, and being inserted into the glue supply line.

12. The apparatus according to claim 11, wherein directions, in which the at least one tappet of two of the glue valves extend, are disposed so as to be rotated relative to each other.

13. The apparatus according to claim 11, wherein the at least one counter element is configured as an independent component and is located in a transition region between the glue chamber and the glue supply line, and includes a hexagon socket on one end thereof.

14. The apparatus according to claim 11, wherein the at least one tappet passes, at least in part, through the glue chamber.

15. The apparatus according to claim 11, wherein the at least one tappet is displaceable via an electromagnetic displacement drive.

16. An apparatus for applying a glue to regions of paper or plastic webs or paper or plastic web-sections for the production of paper sacks, said apparatus comprising:

a nozzle unit including a plurality of glue outlet openings and glue supply lines, and a plurality of glue valves via which the glue supply lines are provided selectively with the glue, each of the glue valves including at least one tappet having a sealing head and at least one counter element, with which the sealing head makes sealing contact; and a glue chamber, via which the glue is provided, the at least one counter element (i) being disposed in, or in close vicinity to, the glue chamber, (ii) being configured as an independent component and being located in a transition region between the glue chamber and the glue supply line, and (iii) including a hexagon socket on one end thereof.

17. The apparatus according to claim 16, wherein directions in which the at least one tappet of two of the glue valves extend are disposed so as to be rotated relative to each other.

18. The apparatus according to claim 16, wherein the at least one counter element is cylindrical or discoidal with a thread on an external surface thereof, and is threaded into a bore that is provided with an internal thread, and is inserted into the glue supply line.

19. The apparatus according to claim 16, wherein the at least one tappet is displaceable via an electromagnetic displacement drive.

20. The apparatus according to claim 19, wherein the electromagnetic displacement drive is disposed directly on the glue chamber.

* * * * *